United States Patent [19]

Martin et al.

[11] 4,334,456

[45] * Jun. 15, 1982

[54] GUITAR NECK FRET ASSEMBLY

[76] Inventors: James O. Martin, 249 Ridgewood Rd., Goodlettsville, Tenn. 37072; Rex D. Fathergill, Rte. 6, Frankfort, Ky. 40601; David L. Krimm, 286 Tangley Way, Lexington, Ky. 40503

[ * ] Notice: The portion of the term of this patent subsequent to Feb. 26, 1997, has been disclaimed.

[21] Appl. No.: 102,371

[22] Filed: Dec. 10, 1979

Related U.S. Application Data

[63] Continuation-in-part of Ser. No. 944,927, Sep. 22, 1978, Pat. No. 4,189,974.

[51] Int. Cl.[3] ..... G10D 3/06

[52] U.S. Cl. ..... 84/314 R

[58] Field of Search ..... 84/314 R

[56] References Cited

U.S. PATENT DOCUMENTS

| | | | |
|---|---|---|---|
| 332,538 | 12/1885 | Kelly | 84/314 R |
| 4,189,974 | 2/1980 | Martin et al. | 84/293 |
| 4,221,151 | 9/1980 | Barth | 84/314 R |

*Primary Examiner*—Lawrence R. Franklin
*Attorney, Agent, or Firm*—Harrington A. Lackey

[57] ABSTRACT

A fret assembly for a stringed musical instrument having an elongated neck body, comprising a ladder-like structure including a pair of elongated support rods upon which are fixed a plurality of longitudinally spaced, transverse fret bars, and a clamp member for detachably securing the support rods longitudinally upon the top surface of the neck body.

7 Claims, 5 Drawing Figures

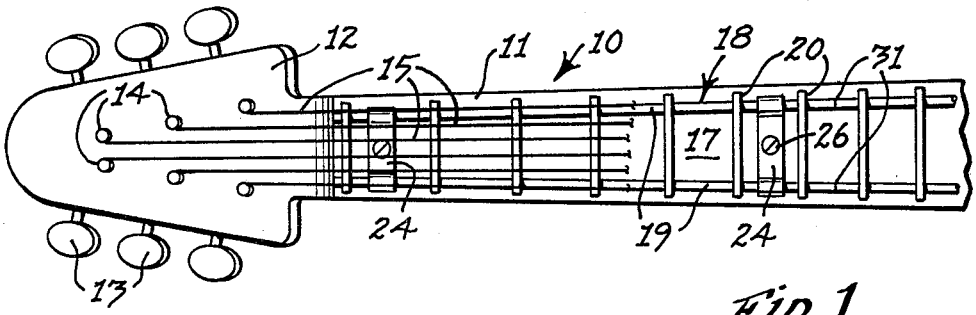
Fig. 1
Fig. 2
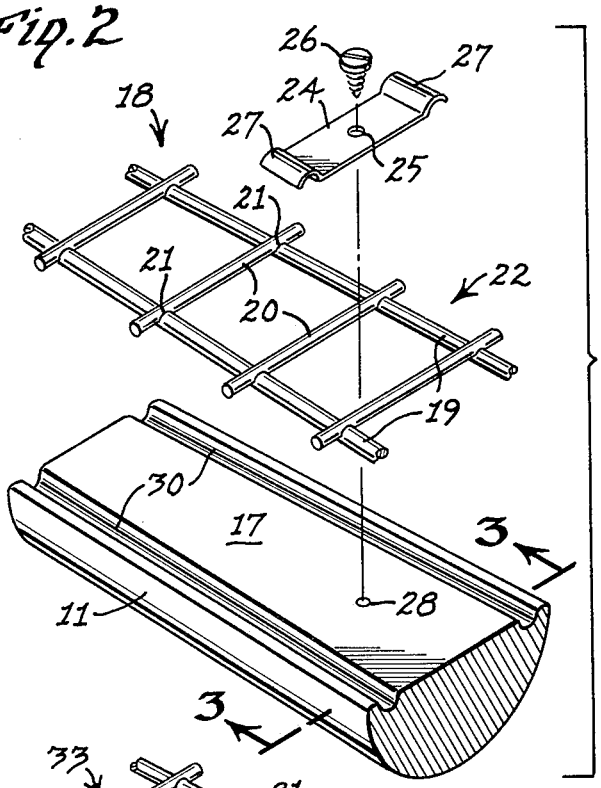
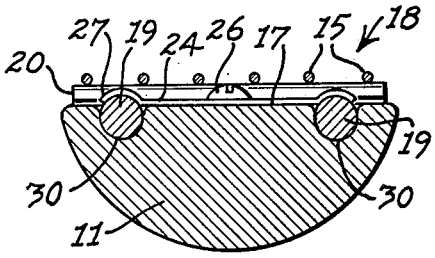
Fig. 3
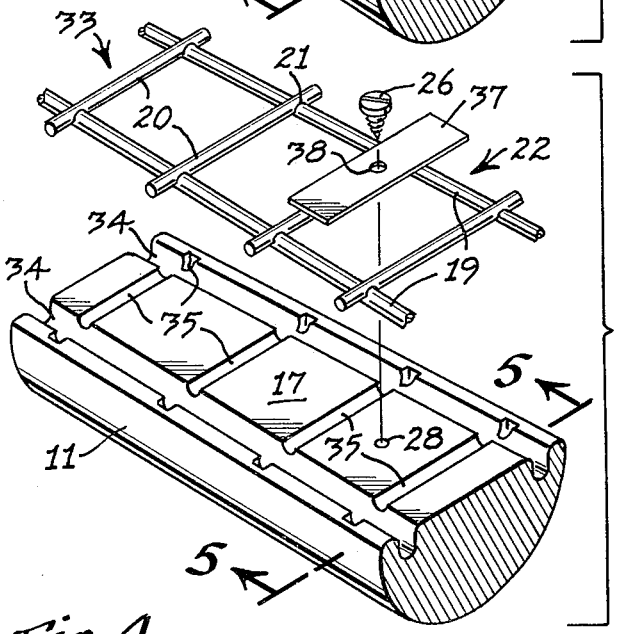
Fig. 4
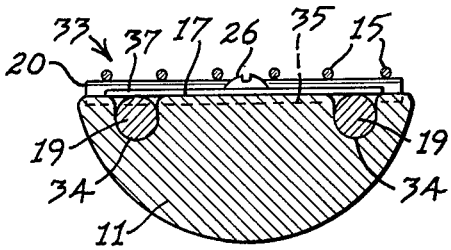
Fig. 5

GUITAR NECK FRET ASSEMBLY

Cross-Reference To Related Application

This application is a continuation-in-part of co-pending patent application Ser. No. 944,927, filed Sept. 22, 1978, for GUITAR NECK ASSEMBLY, now U.S. Pat. No. 4,189,974.

BACKGROUND OF THE INVENTION

This invention relates to a stringed musical instrument, and more particularly to a fret assembly for the neck of a stringed musical instrument.

Conventionally, the necks of stringed musical instruments are of solid material, or at least have an elongated top surface, upon which the longitudinally spaced transverse frets are mounted, to form a fingerboard against which the strings are manipulated or pressed by the musician.

Applicants co-pending application Ser. No. 944,927, filed Sept. 22, 1978, for GUITAR NECK ASSEMBLY, discloses a fret assembly for detachably mounting upon an open-top, hollow neck body.

However, it is not believed that fret assemblies are known for detachably mounting upon existing neck bodies of stringed musical instruments, in order to facilitate replacement and maintenance of the fret bars. Conventional neck bodies are usually of solid material, such as wood, or more recent hollow core graphite composite necks, all of which have solid or continuous top surfaces either flat or transversely convex.

SUMMARY OF THE INVENTION

It is therefore an object of this invention to provide a fret assembly which is prefabricated and adapted to be detachably mounted upon the top surface of an existing or conventional neck body of a stringed musical instrument, in order to facilitate replacement and maintenance of the fret bars.

More specifically, the fret assembly includes a pair of substantially parallel support rods upon which are fixed a plurality of uniform, and uniformly longitudinally spaced, fret bars, which are raised above one longitudinal surface of the support rods. The transverse spacing between the support rods is such that the support rods may easily fit and be secured to the top surface of the existing neck body. Clamp means, preferably a plurality of clamp members or plates, long enough to span both support rods are placed over the support rods and secured to the top surface of the neck body by detachable fastener means, such as threaded screws or bolts extending through a corresponding hole in the clamp member and into threaded engagement with a threaded hole in the top surface of the neck body.

This ladder-like fret structure may be long enough to occupy the entire length of the neck body of the stringed musical instrument, or it may be formed in shorter sections adapted to be mounted end-to-end on the neck body.

The top surface of the neck body may have a pair of longitudinal grooves of substantially the same size and shape and the same spacing as the support rods in order to receive the support rods and thereby permit the transverse fret bars to lie closer to, or directly upon, the top surface of the neck body.

Furthermore, the top surface of the neck body may have transverse grooves, in addition to the longitudinal grooves, the transverse grooves having the same shape, size and spacing as the fret bars in order to receive the fret bars, thereby permitting only a portion of the fret bars to project above the top surface of the neck body. The depths of the grooves will therefore dictate the height which the fret bars project above the top surface of the neck body.

Where the fret bars project high above the top surface of the neck body the musician has more freedom in the application of finger pressure upon the strings against the surfaces of the frets. The strings not only may be pressed downward upon the fret perpendicular to the axis of the body, but also may be pressed at angles to the perpendicular against the side surfaces of the frets, to provide easier "note bending."

The fret assembly made in accordance with this invention not only facilitates the production of the fret bar assembly on the neck body, but also permits the owner of the musical instrument to more easily service the instrument by being able to easily remove and replace the fret bar assembly or fret bar assembly sections, when necessary. The fret bar assembly made in accordance with this invention therefore provides a reduction in time and cost, not only in the original manufacture of the stringed musical instrument, but also in its maintenance.

BRIEF DESCRIPTION OF THE DRAWINGS

FIG. 1 is a fragmentary, top plan view of the upper end portion of a guitar upon which the fret assembly, made in accordance with this invention, is mounted;

FIG. 2 is a fragmentary, exploded, top perspective view of a portion of the fret assembly and guitar neck body disclosed in FIG. 1;

FIG. 3 is a slightly enlarged section taken along the line 3—3 of FIG. 2, disclosing the fret assembly mounted on the guitar neck body;

FIG. 4 is a fragmentary, exploded, top perspective view of a modified fret assembly and neck body, made in accordance with this invention; and FIG. 5 is a slightly enlarged section taken along the line 5—5 of FIG. 4 of the fret assembly mounted on the neck body.

DESCRIPTION OF THE PREFERRED EMBODIMENTS

Referring now to the drawings in more detail, FIG. 1 discloses the upper portion of an electric guitar 10, including a solid neck body 11 and a head 12 supporting the tuners 13 for turning the tuning pegs 14 in order to adjust the tension in the strings 15.

Mounted upon the top surface 17 of the neck body 11 is the fret assembly 18 made in accordance with this invention.

The fret assembly 18 includes a pair of elongated, substantially parallel, support rods 19 upon which are fixedly mounted a plurality of elongated, transverse, longitudinally spaced, fret bars 20. The fret bars 20 are preferably of circular cross-section, and the elongated support rods 19 may also be of circular cross-section.

The spacing between the support rods 19 is less than the width of the top surface 17 of the neck body 11, so that the support rods 19 may rest upon and be secured against the top surface 17, and extend substantially longitudinally of the neck body 11.

The fret bars 20 are long enough to span and be supported by the support rods 19.

In a preferred form of mounting the fret bars 20 upon the support rods 19, transversely aligned notches 21 may be formed in the support rods 19 having a depth less than the diameter of the fret bars 20. The fret bars 20 are then received snugly within the transverse notches 21, and may be secured in place by a suitable adhesive, solder or welding, in order to rigidly fix the fret bars 20 upon the support rods 19 in a ladder-like structure 22, as best disclosed in FIGS. 1 and 2. The depth of each notch 21 is less than the respective diameters of the fret bars 20 so that the fret bars 20 will project above the corresponding longitudinal surfaces of the support rods 19, to enable the strings 15 to be manipulated upon the respective fret bars 20 without interfering with the support rod 19.

The ladder-like structure 22, including the support rods 19 and the fret bars 20, is adapted to be quickly and detachably secured to the top surface 17 of the neck body 11 by detachable clamp means, such as the elongated clamp member 24 having a hole 25 in the center thereof for receiving a threaded fastener member 26. The clamp member 24 may also be provided with concave downward, arcuate end portions 27 adapted to seat against the elongated support rods 19 when securing the ladder-like fret structure 22 against the top surface 17. A threaded hole 28 may be formed in the top surface 17 in order to receive the threaded fastener 26 when the ladder-like fret structure 22 is securely clamped against the top surface 17, as illustrated in FIGS. 1–3.

In the preferred form of the invention, longitudinal grooves 30 are formed in the top surface 17 having the same spacing and substantially the same cross-sectional dimension as the elongated support rods 19. Thus, the grooves 30 will receive the support rods 19, as illustrated in FIG. 3, in order to position the fret bars 20 closer to the top surface 17 than they would be if the support rods 19 were merely clamped flush against the top surface 17 without any grooves. As illustrated in FIG. 3, the fret bars 20 are supported flush against the top surface 17 by virtue of the corresponding depths of the grooves 30.

The ladder-like fret structure 22 may be formed in longitudinal sections, as indicated by the break lines 31 in FIG. 1. There may be two or more sections in order to facilitate assembly, but more importantly to permit replacement of only one section, should such section become worn or defective, necessitating replacing only that section instead of the entire length of the fret assembly 18.

In the modification disclosed in FIGS. 4 and 5, the top surface 17 of the guitar neck body 11 is provided with deeper longitudinal grooves 34 than the longitudinal grooves 30, and is also provided with a plurality of longitudinally spaced transverse grooves 35. The transverse grooves 35 are not as deep as the longitudinal grooves 34 and have the same spacing and cross-sectional dimensions as the corresponding fret bars 20. Thus, as disclosed in FIG. 5, the ladder-like structure 22 may seat more deeply into the top surface 17 of neck body 11 in order to lower the height of the respective fret bars 20 above the top surface 17, thus more nearly simulating conventional fret wires.

The depth of the elongated grooves 34 and the transverse grooves 35 are shallow enough that the fret bars 20 are still raised above the top surface 17 in order for the strings 15 to be manipulated by the operator of the instrument 10.

Since no arcuate end portions 27 are needed, because of the complete recession of the support rods 19 within the grooves 34, the clamp member 37 may be a flat elongated bar, long enough to span the support rods 19. The clamp bar 37 has a center hole 38 through which the threaded fastener 26 extends for threaded reception in the threaded hole 28 in the neck body 11 to clamp the ladder-like fret structure 22 upon the top surface 17 of the neck body 11. When clamped, the support rods 19 are seated within their respective elongated grooves 34 and the transverse bars 20 are seated within their respective transverse grooves 35, as disclosed in FIG. 5.

The construction of the fret assemblies 18 and 33, not only facilitates manufacturing, but also permits assembly in less time than conventional guitar manufacturing. Moreover, relatively unskilled maintenance of the fret assemblies 18 and 33 is required, and rapid replacement of the ladder-like fret structure 22 is permitted.

It will be understood that the number and spacing of the clamp members 24 and 37 will be optional and depend upon the number of clamp members necessary to firmly secure the ladder-like structure 22 upon the top surface 17 of the neck bodies 11.

It will also be understood that although the neck body 11 is disclosed in the drawings as a solid, preferably wood, neck body, the fret assemblies 18 and 33 may be assembled upon other types of neck bodies, and especially conventional neck bodies, which have solid or continuous top surfaces 17, even though the cores of the neck bodies may be hollow.

What is claimed is:

1. A fret assembly for a stringed musical instrument including an elongated neck body having a top surface, comprising:

(a) a pair of elongated, substantially parallel, support rods, (b) a plurality of elongated fret members fixed transversely parallel to each other and longitudinally spaced on, and raised from one longitudinal surface of, said support rods, (c) clamp means for mounting said support rods longitudinally on the top surface of the elongated neck body of a stringed musical instrument to support said fret members transversely of said neck body and at least partially raised above said support rods and said top surface, but beneath the strings of said stringed musical instrument.

2. The invention according to claim 1 in which said fret members are uniform, cylindrical fret bars.

3. The invention according to claim 1 in which said elongated support rods are formed in sectional lengths, each of which pair of sectional lengths are independently detachably secured to the top surface of said neck body.

4. The invention according to claim 1 further comprising a pair of longitudinally extending grooves formed in the top surface of said neck body having the same transverse spacing as said elongated support rods, for receiving said support rods to mount said transverse fret members over the top surface of said neck body.

5. The invention according to claim 4 further comprising a plurality of transverse grooves formed in the top surface of said neck body, said transverse grooves having the same longitudinal spacing, and substantially the same cross-sectional dimension, as said fret members for receiving said fret members in the top surface of said neck body, yet permitting portions of said fret members to project above said top surface.

6. The invention according to claim 1 in which said clamp means comprises at least one clamp member adapted to transversely span and bear against said support rods, and fastener means detachably connecting each clamp member to said neck body.

7. The invention according to claim 6 in which said fastener means comprises a threaded fastener member, a hole in said clamp member for receiving said threaded fastener member, and a threaded hole in the top surface of said neck body for threadedly engaging said fastener member.

* * * * *